United States Patent [19]

Toyooka

[11] Patent Number: 4,590,781

[45] Date of Patent: May 27, 1986

[54] METHOD FOR FORMING AN ELECTRIC RESISTANCE WELDED STEEL PIPE

[75] Inventor: Takaaki Toyooka, Chiba, Japan

[73] Assignee: Kawasaki Steel Corporation, Hyogo, Japan

[21] Appl. No.: 630,000

[22] Filed: Jul. 12, 1984

[30] Foreign Application Priority Data

Jul. 21, 1983 [JP] Japan ..... 58-131398

[51] Int. Cl.[4] ..... B21D 5/12

[52] U.S. Cl. ..... 72/181; 72/368; 228/17.5; 228/151

[58] Field of Search ..... 29/149.5 DP; 72/51, 72/52, 181, 368; 228/17.5, 146, 147, 148, 150, 151

[56] References Cited

U.S. PATENT DOCUMENTS

| | | | |
|---|---|---|---|
| 922,536 | 5/1909 | Smith | 72/181 X |
| 943,902 | 12/1909 | Steele et al. | 72/181 X |
| 1,756,403 | 4/1930 | Thomson | 228/151 X |
| 1,811,580 | 6/1931 | Goldsborough | 72/51 X |
| 3,270,697 | 9/1966 | Solum | 228/151 X |
| 4,070,887 | 1/1978 | Hankin | 72/52 |
| 4,339,938 | 7/1982 | Nakagawa et al. | 72/181 X |

*Primary Examiner*—E. Michael Combs

*Attorney, Agent, or Firm*—Bierman, Peroff & Muserlian

[57] ABSTRACT

An improved method of forming a skelp into a rounded tubular form in the preparation of an electric resistance welded steel pipe. Different from conventional methods, the skelp is bent in the initial and intermediate forming stages within a limited region alone along the centerline thereof to have a U-shaped flower pattern. Thereafter, the edge portions of the bent skelp are bent in the upstream fin pass rolls to have a curvature of at least 80% of the final curvature with simultaneous overbending in the boundary regions on both sides of the side portions of the rounded skelp. Finally, the rounded skelp is pressed down in the direction to decrease the vertical diameter to bulge out in the transverse direction with simultaneous unbending the overbent portions into the final curvature.

6 Claims, 25 Drawing Figures

B: breakdown
F: fin pass
S: side roll
E: edge forming
C: cage roll forming

METHOD FOR FORMING AN ELECTRIC RESISTANCE WELDED STEEL PIPE

BACKGROUND OF THE INVENTION

The present invention relates to a method for forming an electric resistance welded steel pipe in which a flat skelp is continuously formed by rolls into a rounded skelp of which, after passing through fin pass rolls, both marginal edges are welded together into a finished steel pipe.

In the method for forming an electric resistance welded steel pipe having a seam line running in parallel with the longitudinal axis of the pipe, it is usual that a flat skelp trimmed in a width corresponding to the unfolded circumferential length of the desired pipe is first formed into a semicircular rounded skelp by successively passing through several forming rolls for the initial and intermediate forming stages followed by the stable forming of the edges through fin pass rolls at the finishing stage to finish the rounded skelp to have the predetermined shape and dimensions which is then subjected to the upset welding of the marginal edges to form the seam by means of a squeeze roll. Proper selection of the roll-forming process of the skelp before welding is very important because it is the determining factor for the quality of welding, yield in the forming, productivity and the operating rate of the mill, investment for the facilities, cost for rolls and the like.

The above described forming method of the electric resistance welded steel pipe is essentially a combination of the selected cross-sectional configuration of the skelp, i.e. flower pattern, in the forming process as a software-like technology and the actual selected type of the forming process in the forming facilities as a hardware. The flower pattern here implied means the patterns by which the successively changing cross sectional configuration of the skelp is expressed along the line of the sequence of the rolls at each of which the running skelp is deformed.

In respect of the flower pattern in the initial and intermediate forming stages in the prior art method, the flat skelp undergoes a bending formation over the whole width thereof with an object to reduce the working amount and forming load in the succeeding fin pass forming. The forming in these stages is of course performed in several different ways including the circular bending, combination of the circular bending and edge bending, combination of the W-bending and circular bending and combination of circular bending, edge bending and center bending. Each of these forming processes, however, has several problems such as the increased number of rolls in the initial and intermediate forming stages, increase in the length of the forming line, increased time taken for the adjustment and exchange of the rolls, decreased compatibility of the rolls with different pipe being formed, and the like.

The flower patterns in the above mentioned initial and intermediate forming stages may be of the center bending type which is, however, rarely undertaken in practice for the reasons described below and technically not well established. In the forming by center bending, the bending work of the skelp is started from the center line thereof toward the edge portions and the bending work at the initial and intermediate forming stages is limited to the center portion of the skelp and thereabout so that the bending work in these stages is easier than those in other forming processes. The marginal end portions of the skelp are, however, left unformed in the initial and intermediate forming stages so that the succeeding fin pass forming must accompany the edge bending which is a very difficult matter with increased load in the fin pass forming. Furthermore, the space-path length of the skelp edges in this case is the longest in comparison with other types of forming processes with increased appearance of the edge stretch and the resistance of the skelp against buckling is low because the edge portions have not yet been bent. Therefore, a disadvantage is sometimes unavoidable that edge wave frequently takes place between the roll stands.

In connection with the finish-forming stage, i.e. fin pass forming stage in the prior art method for forming an electric resistance welded steel pipe, two types of forming processes are known with different fin pass flower patterns. One is a forming process with the so-called Yoder-Mckay flower pattern in which the nearly rounded skelp is formed with successively decreasing width so as to increase the roundness of the bent skelp as a whole. The other is a forming process with the so-called Etna-type flower pattern in which the lower half of the skelp is bent in the initial and intermediate forming stages to have the final curvature of the finished pipe with the upper half bent to have 50 to 70% of the final curvature followed by the fin pass forming in which the upper half of the skelp is formed into the final curvature thus to form the marginal edge portions ready to be welded.

Accordingly, the conventional fin pass forming process can be considered as a reduce-type forming method mainly directed to the curvature increasing bending of the nearly rounded skelp.

In the above described Yoder-Mckay forming flower, each fin pass roll must serve to the bending of the rounded skelp over the whole width so that the load on the fin pass forming is relatively large. In addition, roll slip marks are sometimes unavoidable because the width decrease is effected on the side portions of the rounded skelp and the gap between the marginal edges of the rounded skelp is successively decreased resulting in a small edge gap after the final fin pass roll. Accordingly, the V-shape angle in the welding portion is too small to cause several problems including the occurrence of weld defects, generation of sparks at the V-shaped edge portion, appearance of edge waves and the like. A further problem is the increase in the thickness of the marginal edges due to the relatively large fin angle at the upstream-side fin pass rolls.

In the Etna-type flower pattern, on the other hand, the load in the fin pass forming is decreased and occurrence of the roll slip marks is reduced in comparison with the Yoder-Mckay flower pattern. In this case, however, difficulties are encountered in the forming at the initial and intermediate forming stages because the forming work in these stages must include bending over the whole width of the skelp or, in particular, finish bending of the skelp portion corresponding to the lower half of the semicircular bent skelp. Moreover, some of the problems in the Yoder-Mckay flower pattern remain unsolved in this case such as the narrowing of the V-shape angle at the welding portion as a result of narrowing of the edge gap after the final fin pass roll, the trend of the thickness increase at the marginal edges as a result of the increased fin angle at the upstream-side fin pass rolls and the like and the tendency of the thickness increase at the marginal edges is even larger than in the Yoder-Mckay flower pattern.

U.S. Pat. No. 4,339,938 discloses a rounded skelp forming method combined an edge crimping forming process with a sequential O-forming process thereafter. The edge crimping process comprises outermost edge bending and subsequent bending of the inward portion adjacent thereto by means of horizontal edge bend rolls. The circular O-forming process is performed by means of cage rolls disposed along the skelp. The method has such disadvantages as necessity in employing large breakdown rolls, occurrence of roll slip marks, and difficulties in integrated arc configuration in the upstream stages and in adjustment of separately disposed cage rolls.

Pipe manufacturing process composed of Uing, Oing and Expanding is well-known as the two dimensional discontinuous press forming process, which can not be utilized for the three-dimensional caliber roll pipe forming process because the former process is subjected to quite different plastic working technology from the latter with entirely different deforming behavior. In addition, UOE process can not be employed in complicated work such as over-bend forming and the like.

In short, the conventional methods practically performed for the forming of electric resistance welded steel pipes utilize the circular bend forming or a combination of the circular bend forming and another flower pattern as the type of the forming flower in the initial and intermediate forming stages and utilize the Yoder-Mckay or Etna-type flower pattern in the fin pass forming stage, while these forming flowers are actually obtained in a particular forming process such as the step-roll forming, vertical-roll forming, cage-roll forming and the like as is described later with reference to the accompanying drawings. These conventional processes, however, involve numbers of problems including; increase in the number of the forming roll stands as a result of the forming work by bending the skelp over the whole width in the initial and intermediate forming stages; decreased compatibility of the rolls with different kinds of pipes; increase in the length of time taken for the adjustment and replacement of rolls; unacceptable cross sectional form of the rounded skelp; increase in the load in the fin pass forming; narrowing of the V-shape angle at the welding portion as a result of the decrease in the final fin width; thickness increase in the edge portions of the skelp; necessity of adjustment of the fin pass reduction in accordance with the wall thickness or the grade of the product; increase in the residual stress in the circumferential direction of the rounded skelp; and so on.

SUMMARY OF THE INVENTION

The object of the present invention is to provide a novel forming method of a skelp for the preparation of an electric resistance welded steel pipe with improved forming performance not only in the initial and intermediate forming stages but also in the fin pass forming stage in which the yield of the product is increased and the steel pipe product is imparted with improved form and accuracy of size as well as excellent quality of welding.

Another object of the invention is to provide a method of forming for the preparation of an electric resistance welded steel pipe in which the advantage of the process is greatly increased with increase in the operating rate of the mill, reduction of the investment for the mill facilities, decrease in the cost for the rolls and enlargement of the versatility of the process to a wide variety of products.

Thus, the method of the present invention for forming a skelp in the preparation of an electric resistance welded steel pipe comprises the steps of;

(1) bending a skelp by roll forming the center portion thereof alone into a bent skelp having a U-shaped flower pattern leaving both side portions of the skelp unbent by use of holding rolls for successively holding and restraining the marginal edge portions of the skelp and a plurality of center-bend rolls for restraining and forming the skelp along the centerline;

(II) forming the marginal edge portions of the thus bent skelp by upstream fin pass bending to give a curvature of at least 80% of the final curvature of the finished pipe and simultaneously forming the boundary regions between the side portion and edge portion of the rounded skelp and between the side portion and bottom portion of the rounded skelp to give each region a curvature larger than the final curvature of the finished pipe while the side portions of the skelp are restrained from bending; and (III) forming the side portions of the rounded skelp, which have been restrained from bending in the step (II), to successively bulge out in the transverse direction to increase the transverse diameter of the rounded skelp by reducing with the succeeding fin pass rolls mainly in the direction to decrease the vertical diameter of the rounded skelp, whereby the bulge-out forming having forming effects of bending of the side portions of the bent skelp and unbending of the over-bent portions formed in the step (II) along the boundary regions between the side portion and edge portion of the rounded skelp and between the side portion and bottom portion of the rounded skelp.

DETAILED DESCRIPTION OF THE PREFERRED EMBODIMENTS

As is mentioned before, the initial and intermediate forming stages in the prior art skelp forming are performed to give either one of the flower patterns illustrated in FIGS. 1*a* to 1*d* which illustrate each the circular-bend forms, a combination of the circular-bend forming and edge-bend forming, a combination of the W-bend forming and circular-bend forming, or a combination of the circular-bend forming, edge-bend forming and center-bend forming, respectively. Each of these forming processes has its own advantages and disadvantages described before.

Figure 1A:
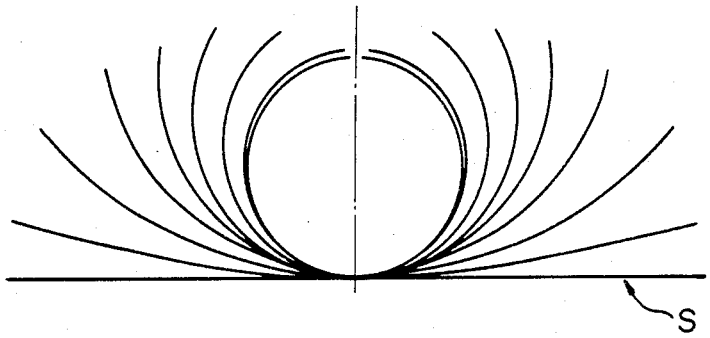
FIG. 1a PRIOR ART
FIGS. 1*a* to 1*d* are each an illustration of a flower pattern in the prior art method of forming.
Figure 1B:
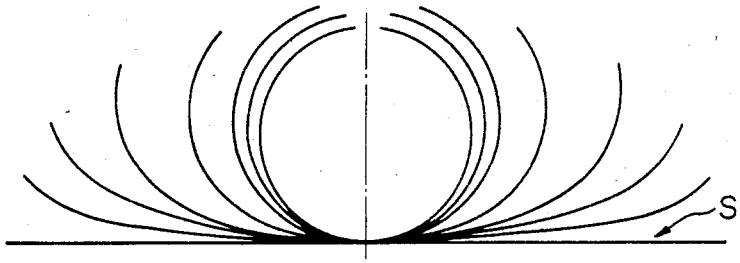
FIG. 1b PRIOR ART
Figure 1C:
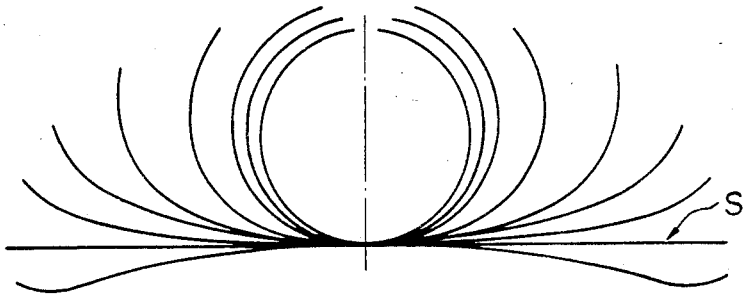
FIG. 1c PRIOR ART
Figure 1D:
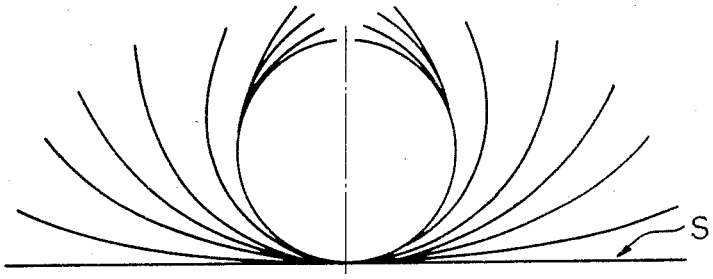
FIG. 1d PRIOR ART
Figure 2A:
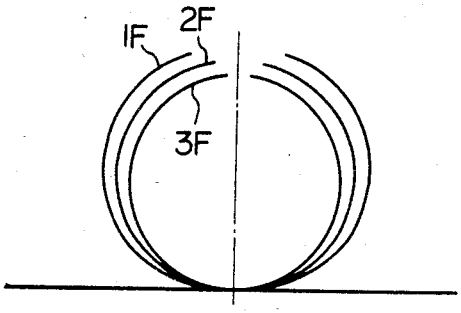
FIG. 2a PRIOR ART
FIGS. 2*a* and 2*b* are each an illustration of a fin pass forming flower in the prior art forming method.
Figure 2B:
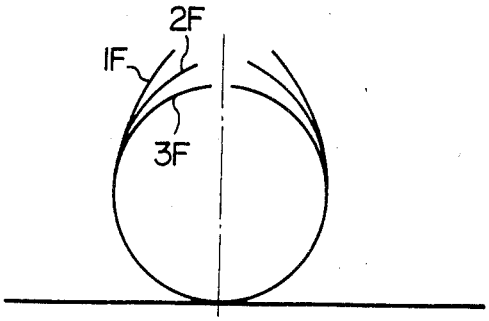
FIG. 2b PRIOR ART

Further, the prior art fin pass forming process gives either one of the flower patterns illustrated in FIGS. 2*a* and 2*b*. FIG. 2*a* illustrates the Yoder-Mckay flower pattern and FIG. 2*b* illustrates the Etna-type flower pattern.

Figure 3A:
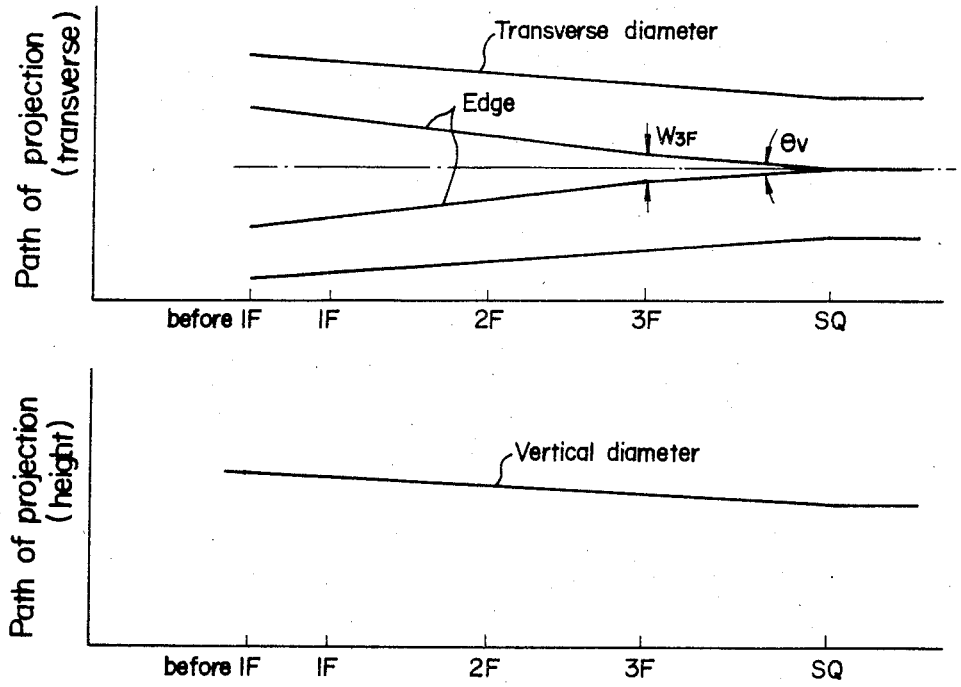
FIG. 3a PRIOR ART
FIGS. 3*a* and 3*b* are each a graph showing the path of the projection in the skelp forming stages according to the prior art method for fin pass forming.
Figure 3B:
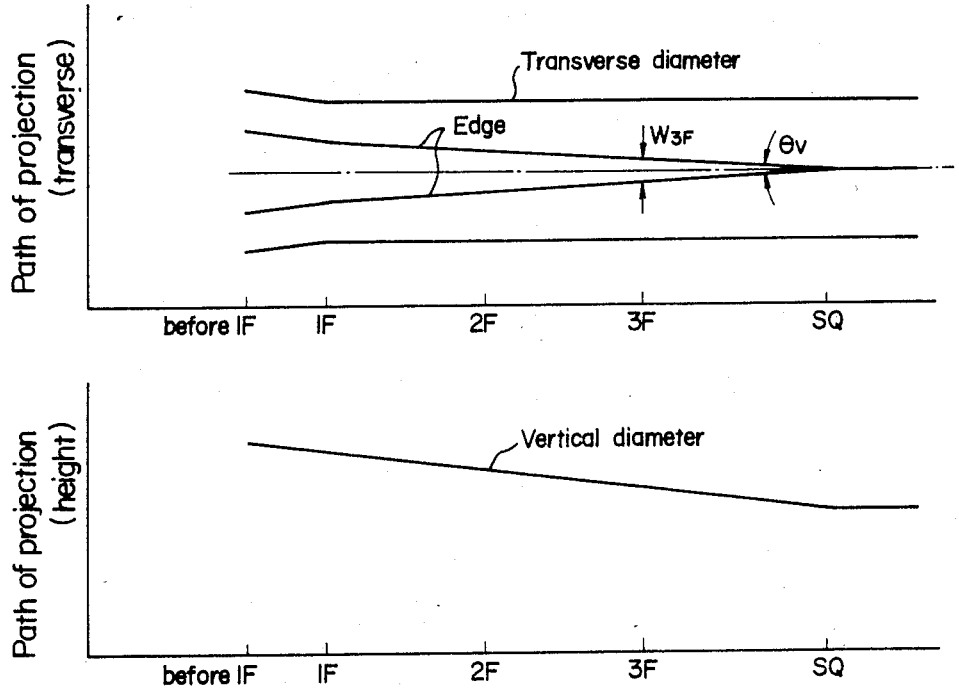
FIG. 3b PRIOR ART

The path of the projection of the edge portion and side portions of the rounded skelp in the stage of the fin pass forming process is shown in the graphs of FIGS. 3*a* and 3*b* for the Yoder-Mckay flower pattern and the Etna-type forming flower, respectively. According to these figures, the projection of the side portions of the rounded skelp indicates a decreasing or constant width in the transverse direction while the lateral projection of the edge portion indicates decreasing height in the vertical direction.

The roll map charts for the above described several types of skelp forming are illustrated in FIGS. 4*a* to 4*d*. The roll map chart here implied is a diagram showing the progress of forming in the transverse direction of the skelp under bending at each of the forming rolls.

Figure 4A:
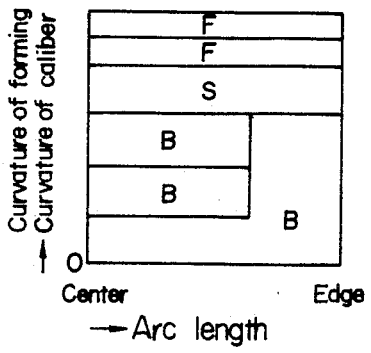
FIG. 4a PRIOR ART
FIGS. 4*a* to 4*d* are each a roll map chart showing the prior art forming method.
Figure 4B:
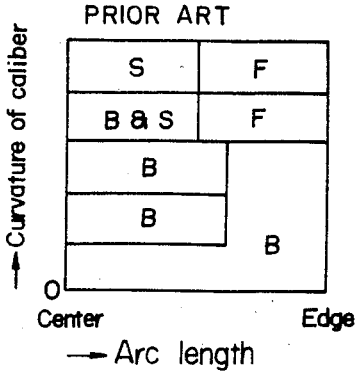
FIG. 4b PRIOR ART
Figure 4C:
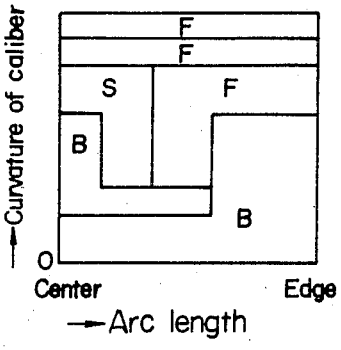
FIG. 4c PRIOR ART
Figure 4D:
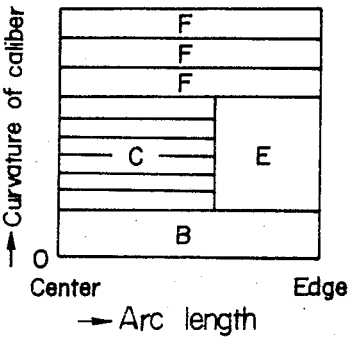
FIG. 4d PRIOR ART

FIG. 4*a* is a roll map chart for the application of the combination of the edge-bend forming and circular-bend forming and the Yoder-type fin pass forming to the step roll forming. FIG. 4*b* is a roll map chart for the application of the combination of the edge-bend forming and circular-bend forming and the Etna-type fin pass forming to the step roll forming. FIG. 4*c* is a roll map chart for the application of the combination of the edge-bend forming and circular-bend forming and a mixed fin pass forming with the Yoder-type and Etna-type to the step roll forming. FIG. 4*d* is a roll map chart for the application of the combination of the edge bend forming and circular-bend forming and the Yoder-type fin pass forming to the cage roll forming.

In the following, the features of the inventive method is described in detail by way of examples illustrated in the accompanying drawings.

Figure 5A:
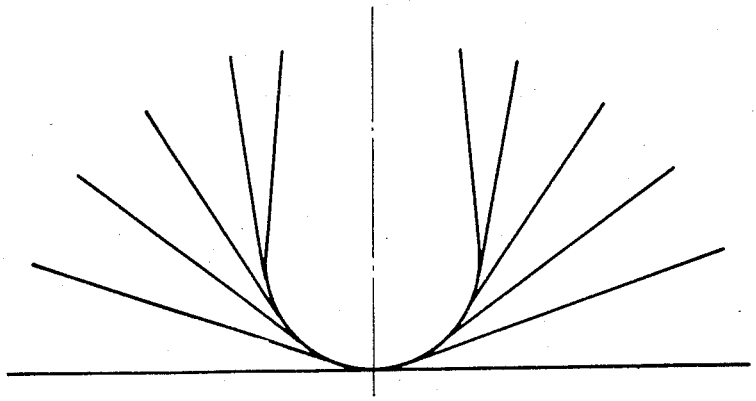
FIGS. 5*a* and 5*b* each illustrate a flower pattern in the center forming step according to the present invention.
Figure 5B:
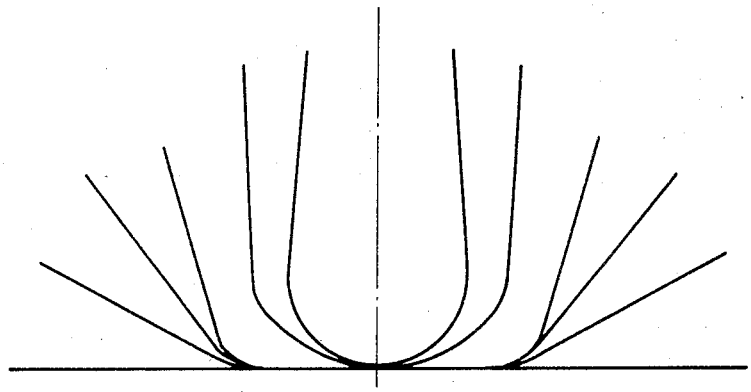
Figure 6A:
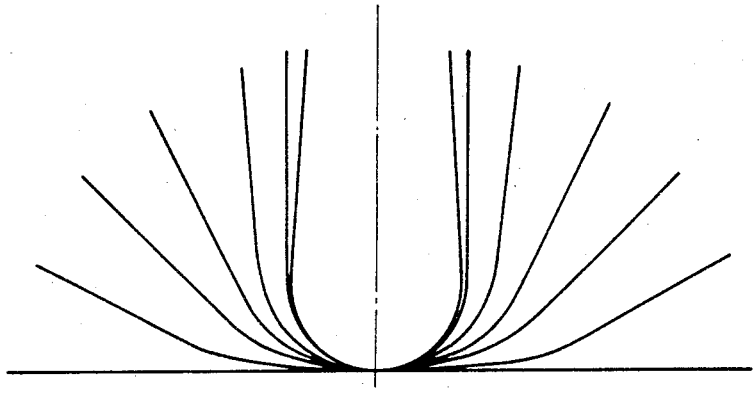
FIG. 6*a* is a flower pattern in the center forming process in the initial and intermediate forming stages according to the present invention and FIG. 6*b* is a typical flower pattern in the forming stages of edge bending of the rounded skelp and bulge-out of the rounded skelp according to the present invention.
Figure 6B:
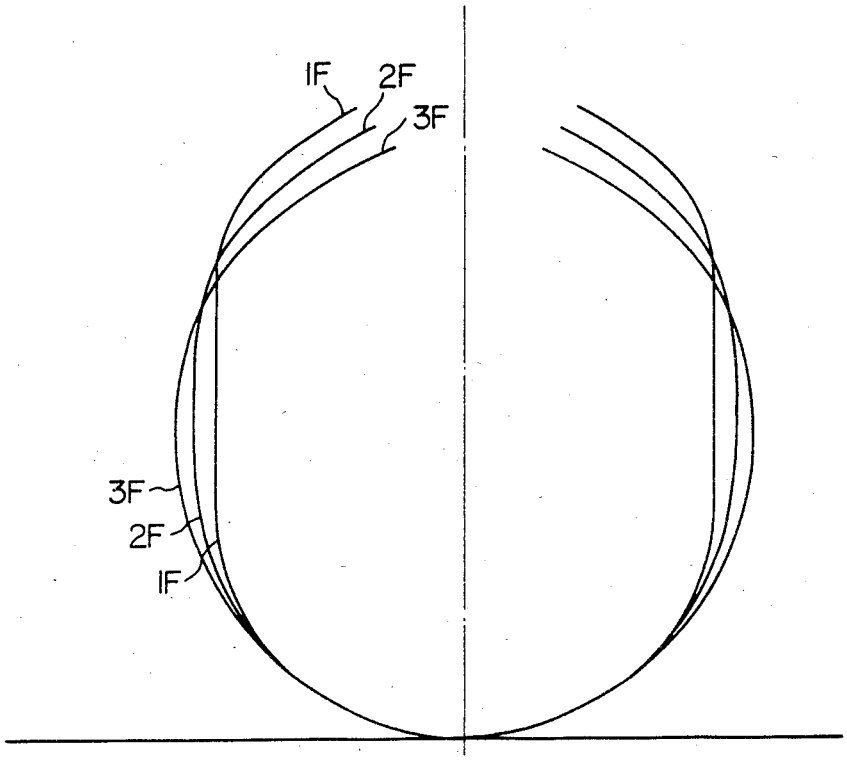
Figure 7A:
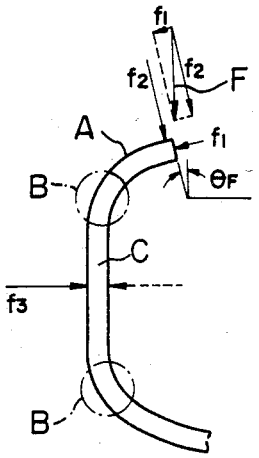
FIG. 7*a* is a schematic illustration of the formed state of the rounded skelp and the forces acting on the rounded skelp in the first fin pass roll forming according to the present invention and FIG. 7*b* is a corresponding illustration for the prior art forming method.
Figure 7B:
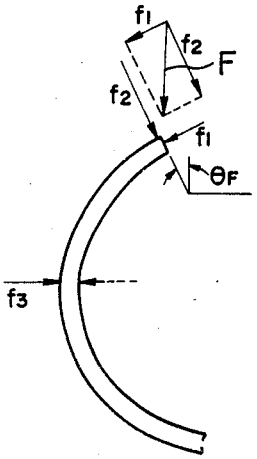
FIG. 7b PRIOR ART

FIGS. 5*a*, 5*b*, 6*a* and 6*b* schematically illustrate the flower patterns obtained in practicing the method of the present invention. The flower patterns illustrated in FIGS. 5*a*, 5*b*, 6*a* are respectively obtained in the center forming processes of the center portion of the skelp in the initial and intermediate forming stages and the forming flower illustrated in FIG. 6*b* is obtained in the forming process of the bent skelp in the stage of finish-forming or the fin pass forming. The three flower patterns illustrated in FIG. 6*b* correspond each to one of the caliber profiles of the roll stands in the case of the 3-stand fin pass forming.

In the first place, description is given of the forming process according to the invention in the initial and intermediate forming stages.

In the initial and intermediate forming stages, the skelp is formed by bending the center portion alone thereof to give a curvature of at least 80% of the final curvature of the finished pipe by use of a cage roll serving as a holding roll to successively hold and restrain the marginal edge portions of the skelp and a plurality of center-bend rolls successively installed along the progressing line of the form and acting to restrain and bend the center portion of the skelp. The other portions of the skelp apart from the centerline in the transverse direction are intentionally left unformed including the marginal edge portions of the skelp each having about one-third width of the skelp from the edge. This is a type of center forming by means of a cage roll in which the skelp is imparted with a U-shaped flower pattern at the inlet of the fin pass forming stage corresponding to the finish forming.

The above described forming process in the initial and intermediate forming steps is characteristic in the omission of the circular forming as is conventional in the prior art forming processes to form the side portions and edge portions of the rounded skelp.

In the above described center forming process according to the invention, the center portion imparted with the specifed curvature should preferably cover from 25 to 50% of the overall width of the skelp in the transverse direction.

The above mentioned step of center forming in the inventive method can be performed in several different ways without particular limitations. For example, the bending work is started along the centerline of the skelp followed by the gradual increase of the width of the bent portion until the above mentioned percentage of the width has been covered to complete the center forming. In contrast thereto, alternatively, the bending work is started along the lines remotest from the centerline within the above mentioned region for bending followed by the successive shift of the bending lines toward the centerline to complete the center forming. FIGS. 5*a* and 5*b* respectively illustrate the flower patterns in the former case and the latter case. It is of course possible to combine these processes so that the flower patterns may be as illustrated in FIG. 6*a*.

At any rate, the first step of the inventive method is the center forming within a limited bending region on both sides of the centerline of the skelp leaving the portions of the skelp outside the bending region unformed.

The types of the roll and apparatus for the above mentioned center forming of the skelp are not particularly limitative and rolls and apparatuses having various forms and structures can be used provided that the above described conditions of bending are satisfied. When the skelp has a down-hill pass line in practicing the inventive method, the chance of occurrence of edge waves can further be decreased even when the thin wall thickness skelp is employed.

In the above described forming process in the initial and intermediate forming stages according to the invention, the edge forming rolls used in the conventional cage forming and the inside rolls for working on the side portions of the skelp are no longer required and the initial and intermediate forming stages, i.e. the cage roll forming, can be greatly shortened in comparison with the prior art methods. In this case, there may be a tendency of edge wave formation due to the increased edge stretch accompanying the increase in the amount of the width reduction of the skelp edges while, in the inventive method, occurrence of edge waves can be prevented because the skelp edges are continuously restrained in the cage roll forming process with further control of the path of width reduction of the skelp edges. According to the experiments undertaken by the inventor, the line length for the initial and intermediate forming stages can be as small as 15 to 20 times of the largest outer diameter of the pipe to be manufactured, that is, the line length can be only about 50 to 70% of that in the conventional cage forming process.

In the next place, description is given of the forming process in the finish forming step, i.e. fin pass forming step, according to the invention.

In the forming of the bent skelp having the U-shaped flower pattern as formed in the preceding initial and intermediate forming stages, the first fin pass roll (1F) in the fin pass forming step serves to perform the following forming process. That is, the bending work on the side portions of the skelp under bending is intentionally limited such that the radius of curvature is not smaller than twice the radius of the finally finished pipe and the transverse diameter, i.e. width, of the side portions of the rounded skelp is not smaller than the transverse diameter of the U-shaped skelp before the first fin pass roll. In this limited working, the edge portions of the skelp are bent and imparted with a curvature of at least 80% of the curvature in the finally finished pipe and over-bend forming is effected in the boundary regions between the side portion and edge portion of the rounded skelp and between the side portion and bottom portion of the rounded skelp to be imparted with a curvature larger than that in the finally finished pipe.

In the above described forming process through the first fin pass roll (1F), the edge portions of the rounded skelp are readily formed by bending with a smaller fin pass reduction and the load in the fin pass forming is decreased.

Following is the reason for the essential requirement in the first fin pass roll (1F) that the edge portions of the rounded skelp are formed by bending to be imparted with a curvature of at least 80% of that in the finally finished pipe. According to the extensive investigations undertaken by the inventor, the above mentioned curvature in the edge portions is essential in order to prevent peaking of the edges by welding leading to unacceptable bead cutting and defective upset welding. In other words, the forming by edge bending in the 2F and 3F to follow cannot be sufficient with the curvature of edge bending in 1F smaller than 80% resulting in deficiency in edge bending.

FIGS. *7a* and *7b* are each a model illustration showing the state of the formed skelp and the forces acting on the rounded skelp in the first fin pass roll according to the inventive method and the prior art forming process, respectively. Assuming that the reduction force F is the same in these two processes, the reaction force $f_3$ is larger in the inventive method than in the prior art method as a result of the restrained bending on the side portion C of the rounded skelp. In the inventive method, furthermore, the boundary region B between the side portion C of the rounded skelp under restrained bending and the edge portion A of the rounded skelp is formed by overbending to be imparted with a curvature larger than that in the edge portion A of the rounded skelp so that the edge is inclined lower than in the prior art method and the fin angle $\theta_F$ of the first fin pass roll can be smaller. Therefore, the circumferential force $f_1$ as a component force of the fin pass reduction force F is decreased and the component force $f_2$ in the radial direction is increased. The thickness increase at the edge is smaller as a result of the decrease of the component force $f_1$ in the circumferential direction while bending of the skelp edge portion can readily be performed as a result of the increase of the component force $f_2$ in the radial direction and the reaction force $f_3$ from the roll to produce an increased bending moment action on the edge portion. Thus, the first fin pass forming process according to the invention has advantages of the smaller thickness increase at the edges and the decrease of the fin pass reduction force in comparison with the prior art forming method.

The above described first fin pass roll (1F) is followed by the second fin pass roll (2F) and the third fin pass roll (3F) which serve to reduce mainly in the direction of decreasing the vertical diameter of the rounded skelp so that the side portions C of the rounded skelp under restrained bending in the above mentioned first fin pass roll (1F) are formed by successively bulging out in the transverse direction to effect forming of the rounded skelp in the direction of increasing the transverse diameter. This forming step by bulging out is a process in which works are successively performed for forming the side portions of the rounded skelp by bending and unbending of the boundary regions B between the side portion and edge portion of the rounded skelp having been formed by over-bending in the first fin pass roll (1F).

Figure 8:
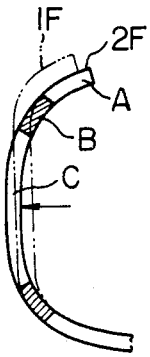
FIG. 8 is an illustration of the forming process in or after the second fin pass roll forming according to the present invention.

FIG. 8 is a schematic illustration showing the forming process after the above mentioned second fin pass roll.

Several different ways may be followed in the bulge-out forming of the side portion of the rounded skelp in the second fin pass roll. For example, it is of course possible to work on the side portion of the rounded skelp under restrained bending in the first fin pass roll as a whole which is successively formed by bending until the predetermined curvature is obtained. It is also possible, alternatively, to first restrain the side portion of the rounded skelp from forming by bending in a similar manner to the forming process in the first fin pass roll followed by successive decrease of the width of the region under restrained forming by bending to complete the forming process for the bulge-out bending.

Although the above description is given for the 3-stand fin pass roll forming taken as an example, the method of the present invention is applicable to the fin pass roll forming with any number of the stands. Further, the applicability of the inventive method is not limited to any division type, i.e. 2-roll type, 4-roll type and so on, of the fin pass rolls.

Figure 9:
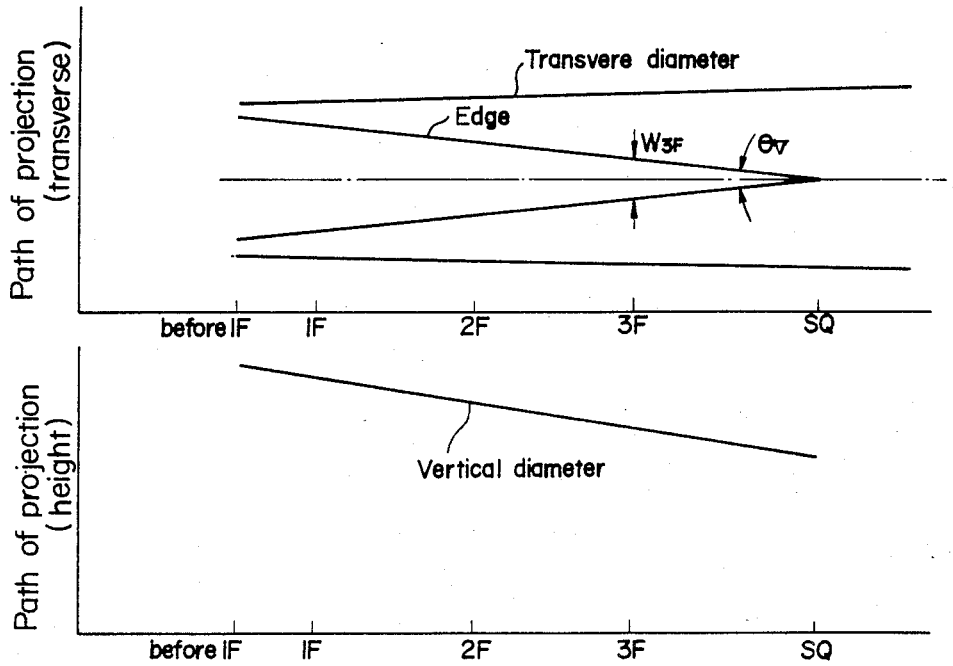
FIG. 9 is a graph of the path of the projection showing the formed stage of the rounded skelp in the fin pass forming process according to the present invention.

FIG. 9 is a diagram showing the paths of the projection of the rounded skelp in the fin pass forming process according to the inventive method. When the fin pass roll forming is performed according to the invention, the edge distance ($W_{3F}$) in the final fin pass roll can be larger owing to the gradual increase in the transverse diameter of the rounded skelp and the V-shaped angle ($\theta_v$) at the welding portion can also be larger. Accordingly, the welding at the squeeze roll can be performed with stability to ensure high quality of the products.

Figure 10A:
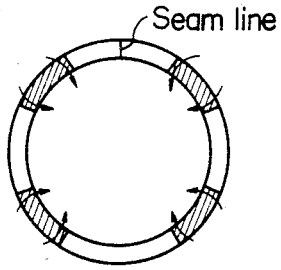
FIG. 10*a* is a schematic cross sectional view of the welded pipe formed according to the present invention showing the residual bending moment in the circumferential direction and FIG. 10*b* is a corresponding illustration for the prior art forming method.
Figure 10B:
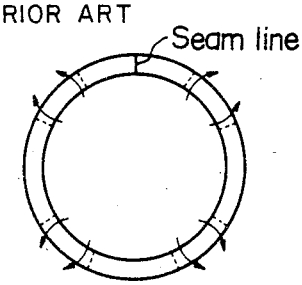
FIG. 10b PRIOR ART

As is understood from the comparison or FIGS. 10*a* and 10*b*, the direction of the residual circumferential bending moment in the rounded skelp after completion of forming is in favor of rounding up of the skelp in the inventive method illustrated in FIG. 10*a* in clear contrast to the prior art method illustrated in FIG. 10*b* so that the finished pipe products after welding are imparted with further improved roundness and size. This advantage is a result of the unbending in the second fin pass roll and thereafter on the portions formed with over-bending in the first fin pass roll.

In the above given description, it is assumed that no edge forming of the skelp is undertaken in the initial and intermediate forming stages. It is of course alternative to undertake edge bend forming of the skelp in the initial forming stage to impart the skelp before the fin pass forming with a flower pattern similar to that obtained in the combination of the edge bend forming and the center bend forming followed by the finish forming in the step of the fin pass forming according to the inventive method. This latter process is advantageous, in particular, in the forming of a skelp of a relatively large thickness with further improved formability of the edge in addition to the decrease of the load in the fin pass forming. That is, the method of the present invention may be practiced by comprising the step of edge bend forming added to the initial and intermediate forming stages in the forming process. Quite different from the center bend forming in the prior art methods, the step of the center forming by the cage roll forming in the initial and intermediate forming stages according to the inventive method can be undertaken only with the precondition of the fin pass forming step according to the inventive method.

The cage roll forming mentioned in the above given description is not an only way for the process of center forming in the initial and intermediate forming stages according to the inventive method but any one of the known forming processes is applicable to the inventive method.

Figure 11:
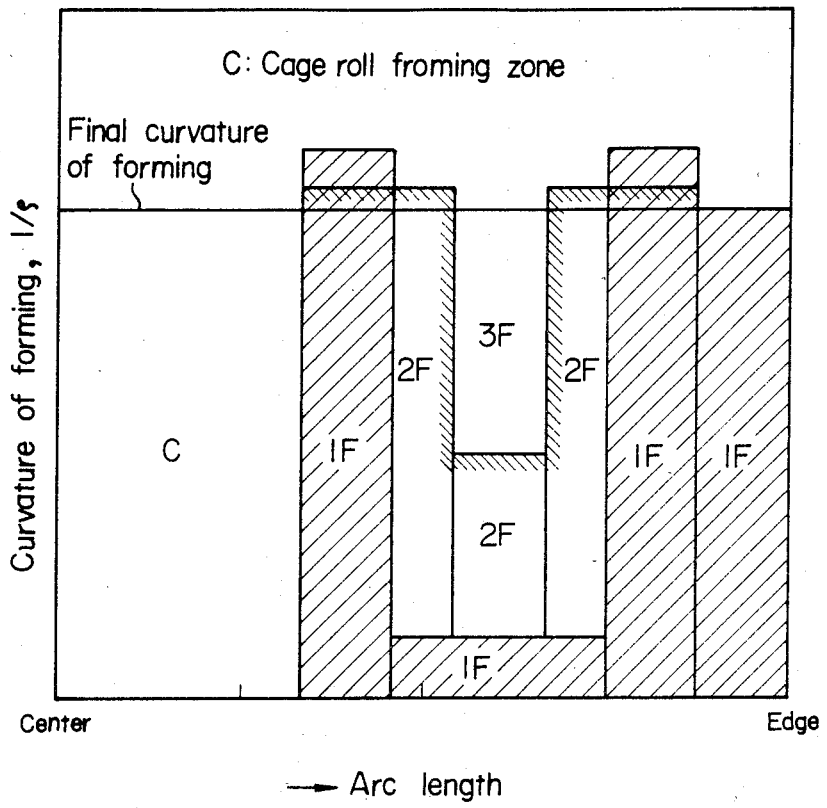
FIG. 11 is a typical roll map chart illustrating a forming process according to the present invention.

FIG. 11 is a roll map chart to illustrate an example of the forming process according to the inventive method.

Figure 12:
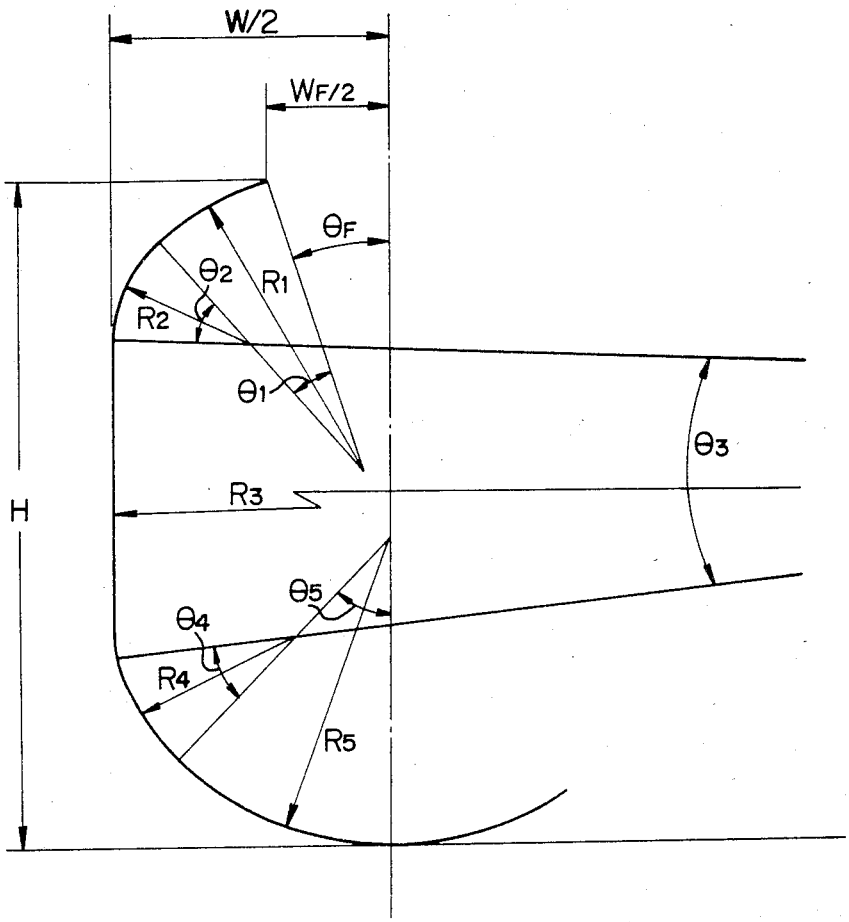
FIG. 12 is a diagram showing an example of the caliber profile of the fin pass roll usable in the fin pass forming process according to the present invention.

FIG. 12 is a diagram to illustrate an example of the caliber profile of the fin pass roll with which the process of the fin pass forming can be performed according to the method of the invention. As is shown in this figure, each fin pass roll along the line of the proceeding fin pass roll forming should have successively modified values for the form and size of the roll caliber profile $R_i$ and $\theta_i$, where i is 1 to 5, as well as the vertical diameter H, transverse diameter W, fin width $W_F$ and fin angle $\theta_F$. As an example, the caliber profile may have successively decreasing values of H, $W_F$, $\theta_F$, $R_3$ and $\theta_3$ and successively increasing values of W, $R_2$, $\theta_2$, $R_4$ and $\theta_4$.

The caliber profile of the squeeze roll used in the inventive method is not limited to a true circularity but it is also possible to utilize a polygonal caliber profile of the squeeze roll as is illustrated in FIG. 12 with extension of the process of fin pass forming according to the inventive method. In this case, the progress of the fin pass forming in the inventive method is moderated to retain the side portions of the rounded skelp under the restrained bending as such in the squeeze roll forming or the following pull-out roll forming and the works on these portions are left to the sizer forming in the succeeding steps. Application of the inventive method in this manner to the zones of fin pass forming and squeeze roll forming has an effect to reduce rotation of the bent skelp around its own axis and consequently to prevent twisting of the welding line on the skelp in the circumferential direction. As a consequence, stabilization can be obtained in the bead cutting and seam annealing as well as the condition of welding and the product of the electric resistance welded steel pipe is imparted with an excellent quality in respect of the condition of the welded portion.

Needless to say, the applicability of the forming process according to the inventive method is not subject to the limitation by the dimensions of the skelp but the inventive method is applicable to the manufacture of electric resistance welded steel pipes of any desired dimensions including the diameter and wall thickness.

In the following, an exemplary description is given of the results obtained in practicing the method of the invention.

The forming process according to the inventive method and the prior art forming process by the cage roll forming to give the flower pattern illustrated in FIG. 4*d* were practiced each for the manufacture of two kinds of electric resistance welded steel pipes, one of the grade API 5LX-X60 having an outer diameter of 24 inches and a wall thickness of 16.0 mm and the other of the grade API 5LX-X56 having an outer diameter of 26 inches and a wall thickness of 6.35 mm specified in the standards of steel pipes. Comparisons were made between the processes for the increase of thickness at the marginal edge, fin pass total reduction, load in the first fin pass forming and number of V-shape sparks taking place in the welding to give the results shown in Table 1. As is clear from the results shown in Table 1, the roll pressure in the fin pass forming was smaller according to the inventive method than in the prior art method to achieve a 50 to 70% decrease in the fin pass total reduction and a 35 to 50% decrease in the fin pass forming load. In addition, the thickness increase at the edge in the inventive method was 50% or smaller of the value in the prior art method so that the bead cutting on the inner surface could be stabilized and occurrence of unacceptable products could be prevented in respect of the cross sectional configuration due to the wall thickness increase at the marginal edges in the case of the thick skelp.

Figure 13:
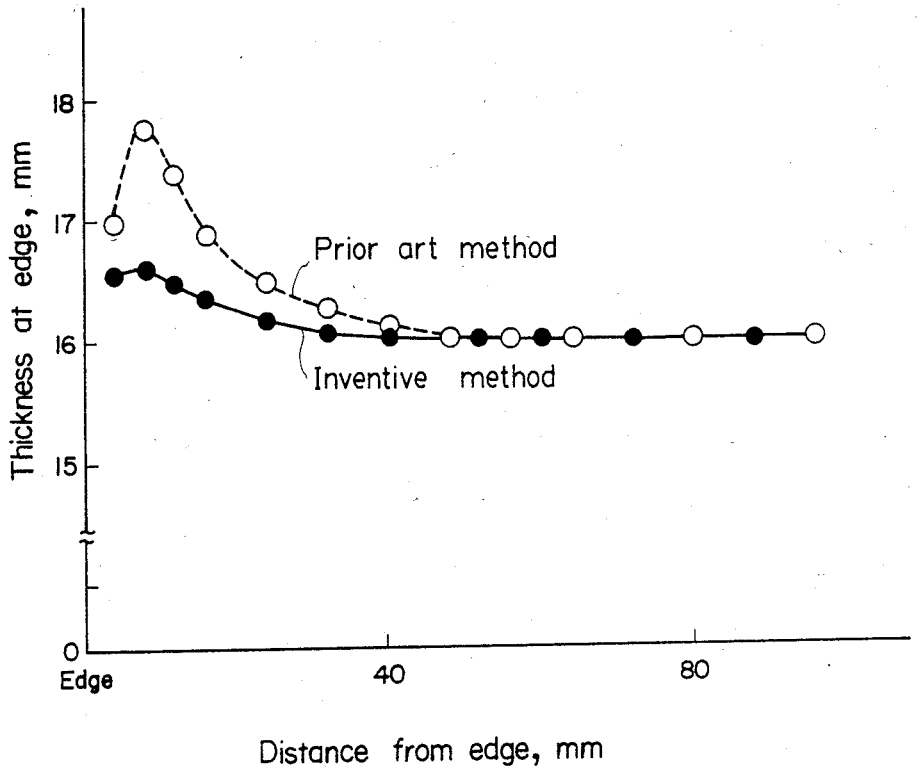
FIG. 13 is a graph showing the distribution of the wall thickness in the edge portion of the rounded skelp after the fin pass forming according to the prior art method or the inventive method.

FIG. 13 is a graph showing the thickness increase at the edge portion in the preparation of the above described 24-inch pipes making comparison between the prior art method and inventive method. It is clear that the inventive method is effective to greatly decrease the thickness increase at the edge portion.

In addition, the inventive method was effective in decreasing the open length at the front and rear ends of the skelp due to incomplete forming by about 50% and the acceptable products could be increased by about 5% in the ultrasonic inspection on the welded portions.

Furthermore, spring-back of the rounded skelp could be decreased in the inventive method as a consequence of the improvement in the direction of the residual bending moment within the circumferential direction of the rounded skelp after the fin pass roll forming and the finished welded pipes could have very exact forms and dimensions.

The method of the present invention has a wide versatility or applicability to the manufacturing processes for the welded steel pipes which can hardly be manufactured by the prior art forming methods for the reasons in the formability of the skelp and the strength of the forming facilities. For example, the inventive method was reproducibly successful in the manufacture of welded steel pipes of 26 inches×6.0 mm (X60) corresponding to the value of t/D (wall thickness/outer diameter) of 0.9% and 20 inches×22 mm (X52) corresponding to the t/D value of 4.3% while welded steel pipes of such grades can be manufactured in the prior art method with great difficulties.

TABLE 1

| | 24" × 16.0 mm (X60) | | 26" × 6.35 mm (X50) | |
|---|---|---|---|---|
| | Prior art method | Inventive method | Prior art method | Inventive method |
| Wall thickness increase at the edge, % | 11 | 4 | 9 | 3 |
| Fin pass total reduction, % | 0.6 | 0.3 | 0.9 | 0.3 |
| Load in the first fin pass forming, ton | 142 | 93 | 41 | 21 |
| Number of V-shape sparks taking place in welding, per coil | 0.2 | 0.02 | 0.16 | 0.02 |

TABLE 2

| | | Prior art method | | | Inventive method | | |
|---|---|---|---|---|---|---|---|
| | | Stands | Sets | Rolls | Stands | Sets | Rolls |
| Pinch rolls | | 1 | 1 | 1 | 1 | 1 | 1 |
| Rough forming rolls | | 1 | 2 | 2 | 1 | 1 | 1 |
| Edge forming rolls | | 1 | 6 | 6 | — | — | — |
| intermediate forming rolls | Cage rolls | 54 | 1 | 54 | 33 | 1 | 33 |
| | Inside forming rolls | 6 | 3 | 18 | — | — | — |
| | Center forming rolls | 3 | 2 | 6 | 4 | 2 | 8 |
| Total | | | | 87 | | | 43 |

As is shown in Table 2, number of stock rolls can be greatly decreased for the initial and intermediate forming stages in the manufacture of 6 grades of welded steel pipes each having an outer diameter in the range from 16 to 26 inches. Thus, the number of the stock rolls in the inventive method can be as small as 43 while the prior art method requires 87. Indeed, the edge forming roll and the inside forming roll indispensable in the prior art method can be omitted in the inventive method.

Accordingly, the line length of the initial and intermediate forming stages can be as short as 15 to 20 times of the maximum outer diameter $D_m$ which is only 50 to 70% of the line length in the prior art forming process. Further, the time required for the replacement of the rolls and adjustment of the rolls can be decreased by about 40% in comparison with the prior art method in the change of the pipe diameter under manufacturing.

It should be noted that the applicability of the inventive method is not limited to the manufacture of pipes having a circular cross section but the inventive method is applicable also to the manufacture of pipes having a rectangular cross section.

The improvements provided by the above described novel method include stabilization and easiness of the rounded skelp forming in the initial and intermediate forming stages, shortened line length as a result of the decreased number of the forming rolls, enlarged versatility of the rolls for a combined use and decrease of the length of time taken for the adjustment and replacement of the rolls. The edge portion of the rounded skelp can be formed by bending in the fin pass forming with prevention of the increase of wall thickness in the edge portions and the load in the forming can be reduced due to the decrease fin pass reduction. The adjustment of reduction can be omitted in the grade change for the thickness of the skelp. Furthermore, the V-shape angle at the welded portion can be increased and the residual stress of the rounded skelp in the circumferential direction can be decreased as a result of the increase in the fin width at the rearmost fin pass roll consequently with an increased yield rate and improvements in the form and size of the pipes and quality of the welded portion of the final products manufactured with increased operating rate of the mill and decreased investment for the facilities and cost for the rolls as well as an enlarged range of the manufacturable grades of the products in a mill.

What is claimed is:

1. A method for forming a skelp in the preparation of an electric resistance welded steel pipe by successively forming said skelp into a rounded, tubular form and leading said rounded skelp to fin pass rolls to effect a finishing work followed by welding together oppositely facing peripheries of marginal end portions of said rounded skelp which comprises the steps of:

(a) bending a skelp by roll forming a region along a centerline of said skelp into a U-shaped flower pattern leaving both side portions of said skelp unbent by the use of holding rolls for successively holding and restraining said marginal edge portions and a plurality of center-bend rolls for restraining and forming said skelp in said centerline region;

(b) forming said edge portions of said bent skelp by bending to give a curvature of at least 80% of a final curvature of a finished pipe while said side portions are restrained from bending by means of upstream-side fin pass rolls and simultaneously forming over-bent portions, each having a curvature larger than said final curvature of said finished pipe along boundary regions between said side portion and edge portion and between said side portion and bottom portion of said rounded skelp; and (c) forming said side portions of said rounded skelp, which have been restrained from bending in step (b) to successively bulge-out in a transverse direction to increase a transverse diameter by decreasing a vertical diameter of said rounded skelp, whereby said bulge-out has forming effects of bending of said side portions and unbending of said over-bent portions formed in step (b) along said boundary regions between said side portions and edge portion and between said side portion and bottom portion of said rounded skelp.

2. The method for forming a rounded skelp as claimed in claim 1, wherein said bending step is provided with center-bend rolls having a forming width from 25% to 50% of a width of said skelp.

3. The method for forming a rounded skelp as claimed in claim 1, wherein said bending step is provided with center-bend rolls having a forming width smaller than a transverse diemater of a roll caliber profile in a first fin pass roll.

4. The method for forming a skelp as claimed in claim 1 wherein bending of the said skelp in step (a) to form a U-shaped flower pattern is started along said centerline region with successive increases in said region from said center towards said edge lines in said transfer direction.

5. The method for forming a skelp as claimed in claim 1 wherein bending of said skelp in step (a) to form a U-shaped flower pattern is started along lines most remote from said centerline region followed by a successive shift of bending lines towards said centerline.

6. The method for forming a skelp as claimed in claim 1 wherein bending of said skelp in step (a) to form a U-shaped flower pattern is started along lines most remote from said centerline region followed by a successive shift of bending lines toward and along said centerline followed by a successive expansion of said bending region in said transverse direction.

* * * * *